US007766690B2

(12) United States Patent
Walker et al.

(10) Patent No.: US 7,766,690 B2
(45) Date of Patent: Aug. 3, 2010

(54) CONNECTOR ASSEMBLY HAVING A PLURALITY OF DISCRETE COMPONENTS

(75) Inventors: Robert Wayne Walker, Harrisburg, PA (US); William Gary Lenker, Marysville, PA (US); Steven Michael Weldon, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/204,044

(22) Filed: Sep. 4, 2008

(65) Prior Publication Data

US 2010/0055953 A1 Mar. 4, 2010

(51) Int. Cl.
*H01R 13/56* (2006.01)

(52) U.S. Cl. ..... 439/447; 439/936; 439/604

(58) Field of Classification Search ..... 439/449, 439/604, 936, 589, 587, 445, 455, 447; 174/76
See application file for complete search history.

(56) References Cited

U.S. PATENT DOCUMENTS

| | | | | |
|---|---|---|---|---|
| 2,429,793 | A | 10/1947 | Benander | |
| 3,986,765 | A * | 10/1976 | Shaffer et al. | 439/314 |
| 4,090,759 | A | 5/1978 | Herrmann, Jr. | |
| 4,433,206 | A * | 2/1984 | Lewis | 174/359 |
| 5,104,340 | A | 4/1992 | Elam et al. | |
| 5,194,021 | A | 3/1993 | Oba et al. | |
| 5,529,508 | A | 6/1996 | Chiotis et al. | |
| 5,700,161 | A | 12/1997 | Plummer et al. | |
| 6,102,739 | A | 8/2000 | Murakami | |
| 6,126,483 | A | 10/2000 | Kirma et al. | |
| 6,361,342 | B1 | 3/2002 | Cox | |
| 7,422,469 | B1 * | 9/2008 | Chang | 439/449 |
| 2002/0013093 | A1 | 1/2002 | Wilbourn et al. | |
| 2004/0033104 | A1 | 2/2004 | Kieninger et al. | |

FOREIGN PATENT DOCUMENTS

| | | |
|---|---|---|
| DE | 85 04 019 | 5/1985 |
| EP | 0 727 842 | 8/1996 |
| WO | WO 2006/086588 | 8/2006 |

OTHER PUBLICATIONS

M12 Female Molding Type Straight Connector. Tyco Electronics, 2 pgs.

(Continued)

*Primary Examiner*—Javaid Nasri

(57) ABSTRACT

A connector assembly includes a boot body, a contact housing, and a contact. The boot body extends between a boot coupling end and a boot back end. The back end receives a cable that includes a conductor. The boot body defines an internal chamber. The contact housing extends between a housing mating end and a housing back end. The contact housing includes a housing coupling element between the housing mating end and the housing back end. The housing back end is coupled to the boot coupling end. The housing mating end is configured to mate with a mating connector to electrically connect the connector assembly and the mating connector. The contact is held in the housing and electrically connected to the conductor. An adhesive is disposed in the internal chamber to secure the boot body and the contact housing together.

18 Claims, 4 Drawing Sheets

OTHER PUBLICATIONS

HDP-20 Connector Contacts, Precision Formed, Amplimite Subminiature D Type Connectors, tycoelectronics.com, 1 pg.
Socket Contact, Size 20 DF, with Solder Cup, Amplimite, Tyco Electronics, 1 pg.
Signal Contacts, AMP Precision Pin and Socket Contacts. Tyco Electronics, 9 pgs.
European Search Report, International Application No. 09169258.2-1231, International Filing Date Feb. 12, 2009.

* cited by examiner

CONNECTOR ASSEMBLY HAVING A PLURALITY OF DISCRETE COMPONENTS

BACKGROUND OF THE INVENTION

The subject matter herein relates generally to electrical connectors, and more particularly, to connector assemblies that mate with one another.

Known connector assemblies are primarily manufactured by overmolding an assembly body over contacts of the connector assembly. Typically, an overmolding manufacturing process whereby the assembly body is overmolded on the contacts is performed in one geographic location. As such, known connectors are primarily manufactured in a single location and do not take advantage of the potential savings in manufacturing cost that may come from separately manufacturing the components of the connector assemblies and later assembling the components together.

But, separately manufacturing the components of connector assemblies in multiple locations and later assembling the components can present problems. First, the connector assemblies may not be adequately sealed from the environment. Gaps or misalignment between coupled components in the connector assemblies may permit the egress of moisture and other fluids into the interior of the connector assemblies. Second, the connector assemblies may not be as structurally and mechanically strong as overmolded connector assemblies. For example, coupling multiple components together may introduce several joints and other interfaces between components that may weaken the overall structure of the connector assemblies.

Thus, a need exits for connector assemblies that are formed from several discrete components and later assembled, while providing adequate sealing and protection from the environment and adequate mechanical strength and integrity of the assemblies. Such connector assemblies may reduce the cost of manufacturing connector assemblies.

BRIEF DESCRIPTION OF THE INVENTION

In one embodiment, a connector assembly includes a boot body, a contact housing, and a contact. The boot body extends between a boot coupling end and a boot back end. The back end receives a cable that includes a conductor. The boot body defines an internal chamber. The contact housing extends between a housing mating end and a housing back end. The contact housing includes a housing coupling element between the housing mating end and the housing back end. The housing back end is coupled to the boot coupling end. The housing mating end is configured to mate with a mating connector to electrically connect the connector assembly and the mating connector. The contact is held in the housing and electrically connected to the conductor. An adhesive is disposed in the internal chamber to secure the boot body and the contact housing together.

In another embodiment, another connector assembly includes a boot body, a contact housing and a contact. The boot body extends between a boot coupling end and a boot back end. The back end receives a cable that includes a conductor. The contact housing extends between a housing mating end and a housing back end. The contact housing includes a housing coupling element between the housing mating end and the housing back end. The housing back end is coupled to the boot coupling end. The housing mating end is configured to mate with a mating connector to electrically connect the connector assembly and the mating connector. The contact is held in the housing and is electrically connected to the conductor. The contact is stamped and formed from a sheet of conductive material. The boot body and the contact housing are discrete elements secured together with an adhesive.

In another embodiment, another connector assembly includes a boot body, a contact housing, a cable and a contact. The boot body extends between a back end and a coupling end. The boot body includes an interior chamber substantially filled with an adhesive. The contact housing is coupled to the boot body in a location proximate to the coupling end of the boot body. The cable is received in the back end of the boot body and extends through the interior chamber of the boot body. The cable includes a conductor. The contact is electrically connected to the conductor in the cable, is held in the contact housing and is configured to electrically connect with a mating contact in the mating connector to electronically connect the connector assembly and the mating connector. Each of the boot body and the contact housing is a discrete element. The boot body, contact housing and cable are secured with one another in the interior chamber by the adhesive.

DETAILED DESCRIPTION OF THE INVENTION

Figure 1:
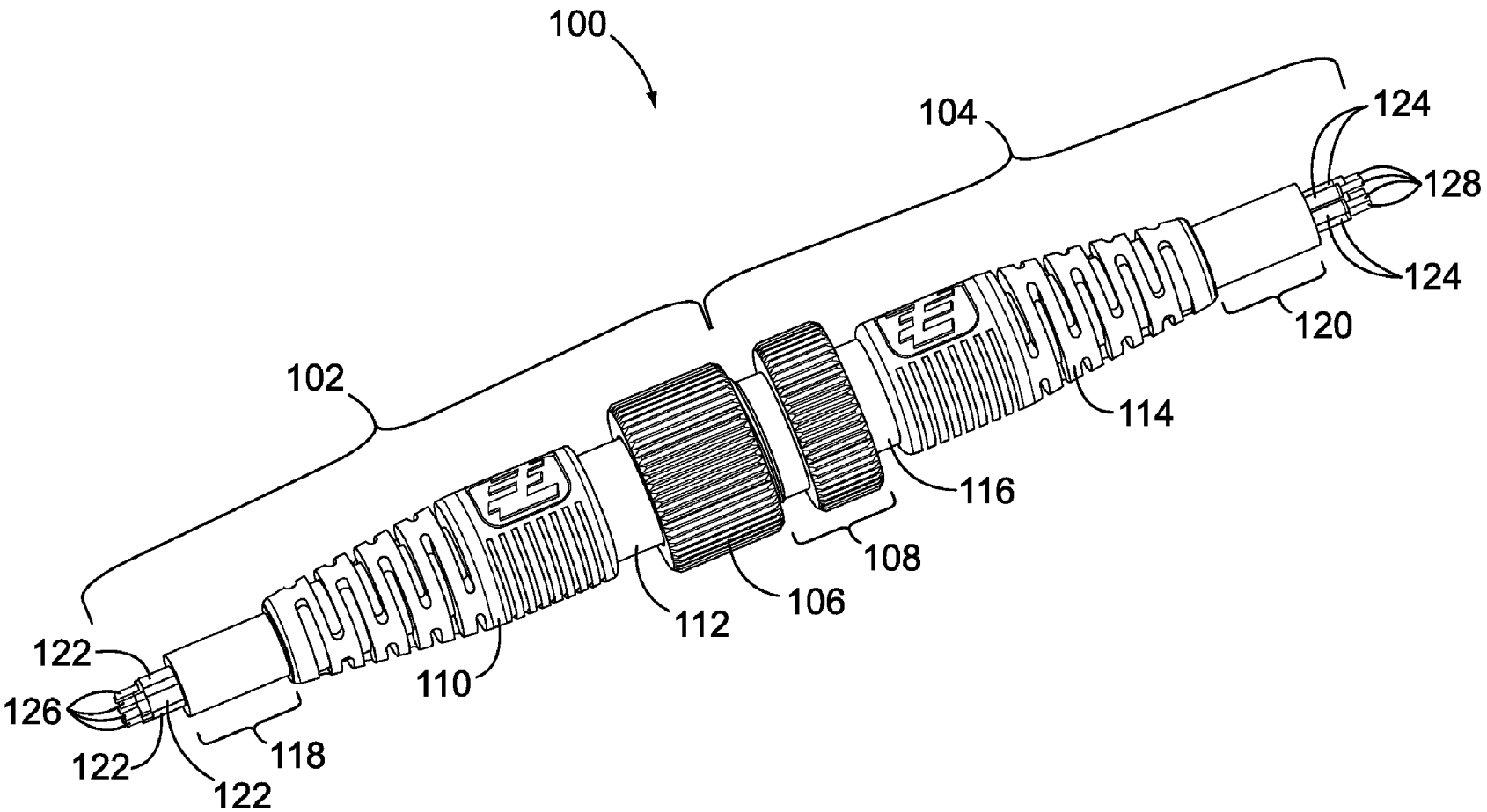
FIG. 1 is a perspective view of a connector system according to one embodiment.

FIG. 1 is a perspective view of a connector system 100 according to one embodiment. The connector system 100 includes a female connector assembly 102 and a male connector assembly 104. The female connector assembly 102 includes a mating end 106 that engages a mating end 108 of the male connector 104 to mechanically secure the female and male connector assemblies 102, 104 together. The female connector assembly 102 includes a boot body 110 that is interconnected with the mating end 106 by a contact housing 112. Similarly, the male connector assembly 104 includes a boot body 114 that is interconnected with the mating end 108 by a contact housing 116. Each of the boot bodies 110, 114 includes a back end 118, 120 that receives a plurality of cables 122, 124. Each cable 122, 124 includes a conductor 126, 128. In one embodiment, the conductors 126, 128 are single wires. In another embodiment, the conductors 126, 128 include twisted wire pairs.

The mating end 108 of the male connector assembly 104 is inserted into the mating end 106 of the female connector assembly 102 to mechanically secure and electrically connect the male and female connector assemblies 104, 102. In one embodiment, the male connector assembly 104 includes a threaded connection (not shown) in the mating end 108 and the female connector assembly 102 includes a corresponding threaded interface 240 (shown in FIG. 2) in the mating end 106. In the illustrated embodiment the female and male connector assemblies 102, 104 are M-series connectors.

Figure 2:
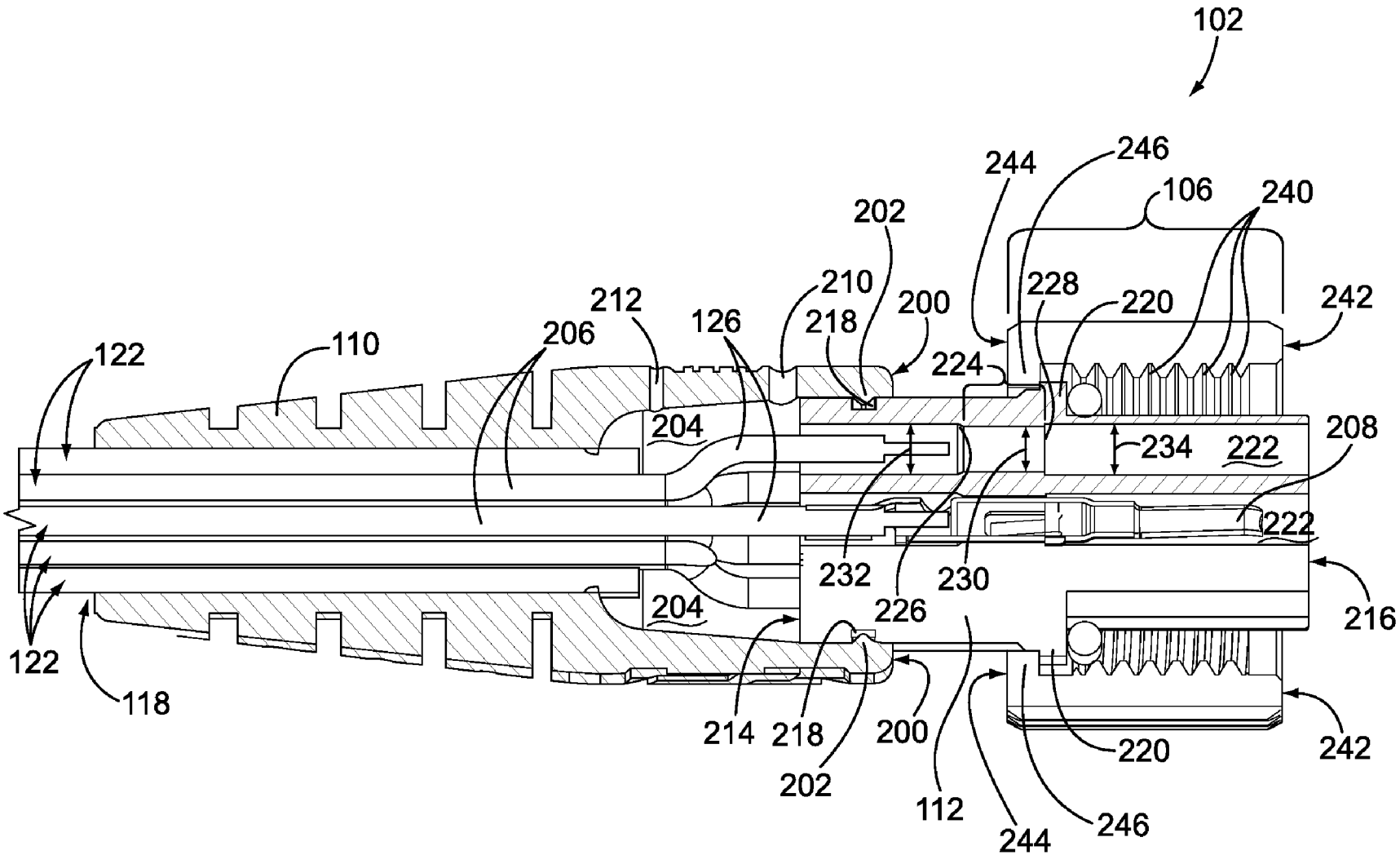
FIG. 2 is a partial cut-away view of a female connector assembly shown in FIG. 1.

FIG. 2 is a partial cut-away view of the female connector assembly 102. While the female connector assembly 102 is described, one or more embodiments described herein also may apply to the male connector assembly 104 (shown in FIG. 1). In one embodiment, the boot body 110 includes, or is formed from, a dielectric material. For example, the boot body 110 may be formed from a plastic material. The boot body 110 extends between the back end 118 and a boot coupling end 200. The back end 118 receives the cables 122. The boot coupling end 200 couples the boot body 110 with the contact housing 112. The boot coupling end 200 includes a coupling element 202 to mechanically engage the contact housing 112. In the illustrated embodiment, the coupling element 202 includes a flange. Alternatively, the coupling element 202 includes one or more different components to couple the boot coupling end 200 with the contact housing 112. For example, the coupling element 202 may include a C ring to couple the boot coupling end 200 with the contact housing 112. The boot body 110 defines an interior chamber 204 between the back end 118 and the boot coupling end 200. In the illustrated embodiment, an adhesive port 210 and an evacuation port 212 provide access to the interior chamber 204 from outside of the boot body 110.

The cables 122 include a nonconductive sheath 206 that substantially surrounds the conductors 126. In the illustrated embodiment, the sheath extends from the back end 118 into the interior chamber 204, while each of the conductors 126 extends from the back end 118, through the interior chamber 204 past the ends of the sheaths 206, and terminates at a contact 208.

In one embodiment, the contact housing 112 includes, or is formed from, a dielectric material. For example, the contact housing 112 may be formed from a plastic material. The contact housing 112 extends between a housing back end 214 and a housing mating end 216. In the illustrated embodiment, the housing back end 214 is disposed within the boot body 110 and the housing mating end 216 partially protrudes from the mating end 106 of the female connector assembly 102. The contact housing 112 includes a coupling interface 218 in a location that is proximate to the housing back end 214. The coupling interface 218 receives the coupling element 202 of the boot body 110 to mechanically couple the boot body 110 and the contact housing 112. In the illustrated embodiment, the coupling interface 218 is a slot that substantially extends around the contact housing 112. The housing mating end 216 is received by the male connector assembly 104 (shown in FIG. 1) to mate and electrically connect the female and male connector assemblies 102, 104. The contact housing 112 includes a housing coupling element 220 between the housing mating end 216 and the housing back end 214. In the illustrated embodiment, the housing coupling element 220 is disposed between the coupling interface 218 and the housing mating end 216. The housing coupling element 220 couples the contact housing 112 with the mating end 106 of the female connector assembly 104. In one embodiment, the housing coupling element 220 is a flange. Alternatively, the housing coupling element 220 is another component of the housing 112 that couples the contact housing 112 and mating end 216 together.

In one embodiment, the contact housing 112 includes a plurality of housing chambers 222. The housing chambers 222 hold the contacts 218 and align the contacts 218 with respect to corresponding contacts (not shown) in the male connector assembly 104 (shown in FIG. 1). In the illustrated embodiment, each of the housing chambers 222 includes a bottleneck portion 224. The bottleneck portion 224 extends between a pair of ledges 226, 228 in the housing chambers 222. Alternatively, one of the ledges 226, 228 is omitted and the bottleneck portion 224 extends from the other ledge 226, 228 towards one of the housing mating and back ends 216, 214. The bottleneck portion 224 includes an inside diameter 230 that is smaller than inside diameters 232, 234 of the housing chambers 222. The inside diameter 232 is the inside diameter of the housing chamber 222 between the housing back end 214 and the ledge 226. The inside diameter 234 is the inside diameter of the housing chamber 222 between the ledge 228 and the housing mating end 216. In one embodiment, the inside diameters 232, 234 are substantially the same. Alternatively, the inside diameters 232, 234 differ from one another.

The mating end 106 includes the threaded interface 240 that engages the mating end 108 (shown in FIG. 1) of the male connector assembly 104 to mechanically secure the female and male connector assemblies 102, 104 together. The mating end 106 extends between front and back ends 242, 244. In one embodiment, the mating end 106 includes a coupling interface 246 in a location that is proximate to the back end 244. The coupling interface 246 engages the housing coupling element 220 to mechanically engage the mating end 106 and the contact housing 112. In the illustrated embodiment, the coupling interface 246 includes a ledge that engages the housing coupling element 220.

In one embodiment, each of the boot body 110 and the contact housing 112 are discrete elements that are separately formed from one another. For example, rather than mold the boot body 110 and the contact housing 112 as a single, homogeneously formed component over the contacts 208 in an over molding process, the boot body 110 may be formed from a dielectric material, the contact housing 112 formed from a dielectric material, and then the boot body 110 and contact housing 112 coupled to one another as described above. In one embodiment, the mating end 106 similarly is separately formed from the boot body 110 and the contact housing 112.

The interior chamber 204 may be filled with an adhesive material to bond a plurality of the contact housing 112, the boot body 110 and one or more of the cables 122 together and/or to seal the housing back end 214. For example, an adhesive such as an epoxy may be loaded or inserted into the interior chamber 204 through the adhesive port 210. As the adhesive is loaded into the interior chamber 204, the air in the interior chamber 204 may be evacuated or otherwise forced out from the interior chamber 204 through the evacuation port 212. In one embodiment, substantially all of the interior chamber 204 is filled with the adhesive. The adhesive may seal the housing back end 214 and prevent the egress of moisture or other fluids into the boot body 110. For example, the adhesive may seal the housing back end 214 so that moisture and other fluids cannot travel into the boot body 110 from the interface between the coupling element 202 of the boot body 110 and the coupling interface 218 of the contact housing 112.

Figure 3:
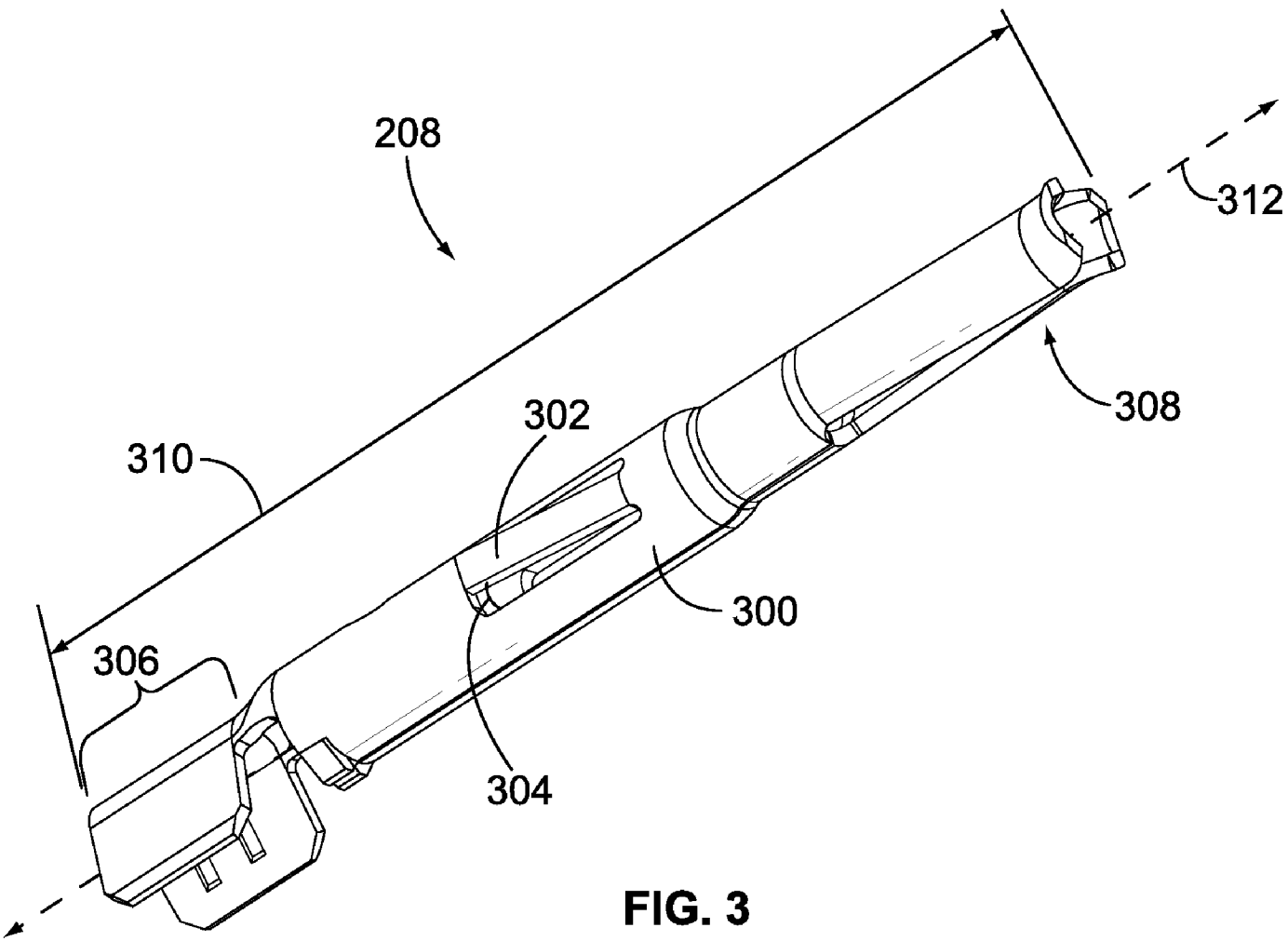
FIG. 3 is a perspective view of a contact shown in FIG. 2 according to one embodiment.

FIG. 3 is a perspective view of the contact 208 according to one embodiment. The contact 208 includes, or is formed from a conductive material. For example, the contact 208 may be stamped and formed from a sheet of conductive material. In another embodiment, the contact 208 may be screw machined from a block of conductive material. Alternatively, the contact 208 includes, or is formed from, a nonconductive material and at least a portion of the contact 208 is coated with a conductive material. For example, the contact 208 may be formed from a polymer material that is at least partially coated with a conductive plating, such as a metal plating.

In the illustrated embodiment, the contact 208 includes a body 300 with a contact mating end 308 extending from one end of the body 300 and a crimp portion 306 extending from an opposing end of the body 300. The contact mating end 308 includes a portion of the contact 208 that engages a mating contact (not shown) in the male connector assembly 104 (shown in FIG. 1) to electrically connect the female and male connector assemblies 102, 104 (shown in FIG. 1). The crimp portion 306 receives the conductor 126 (shown in FIG. 1) to electrically connect the conductor 126 and the contact 208. The crimp portion 306 may be crimped onto the conductor 126 to engage the conductor 126. In one embodiment, the contact 208 is a relatively small contact. For example, the contact 208 may have an overall length 310 along a longitudinal axis 312 of the contact 208 of 0.750 inches or less.

A plurality of retention elements 302 extend from the body 300 and engage the ledge 228 (shown in FIG. 2) to retain the contact 208 in the contact housing 112 (shown in FIG. 1). For example, each retention element 302 may include a cantilevered beam that extends away from the body 300 at an angle 304. The retention elements 302 and the body 300 may be homogeneously formed with one another. For example, the retention elements 302 and the body 300 may be stamped and formed from a sheet of conductive material. As the contact 208 is loaded into the housing chamber 222 (shown in FIG. 2) of the contact housing 112 through the housing back end 214 (shown in FIG. 2), the retention element 302 is biased towards the body 300. If the contact 208 is loaded sufficiently far such that the retention element 302 is past the ledge 228, the retention element 302 may return to an unbiased position. In the unbiased position, the retention element 302 is positioned to engage the ledge 228 to prevent the contact 208 from being removed from the housing chamber 222 in a direction toward the housing back end 214 (shown in FIG. 2). Alternatively, the retention element 302 may extend from the body 300 in an opposing direction as is shown in FIG. 3 in order to engage the ledge 226 (shown in FIG. 2). In another embodiment, the retention element 302 engages another component of the contact housing 112 to prevent removal of the contact 208 from the contact housing 112. For example, the retention element 302 may engage a flange (not shown), protrusion (not shown) or other component in the contact housing 112. In another example, the retention element 302 is assembled or formed as a part of the contact housing 112. The retention element 302 may be a cantilevered beam that extends from the contact housing 112 to engage a portion of the contact 208. In another embodiment, the retention element 302 includes a component other than a cantilevered beam.

Figure 4:
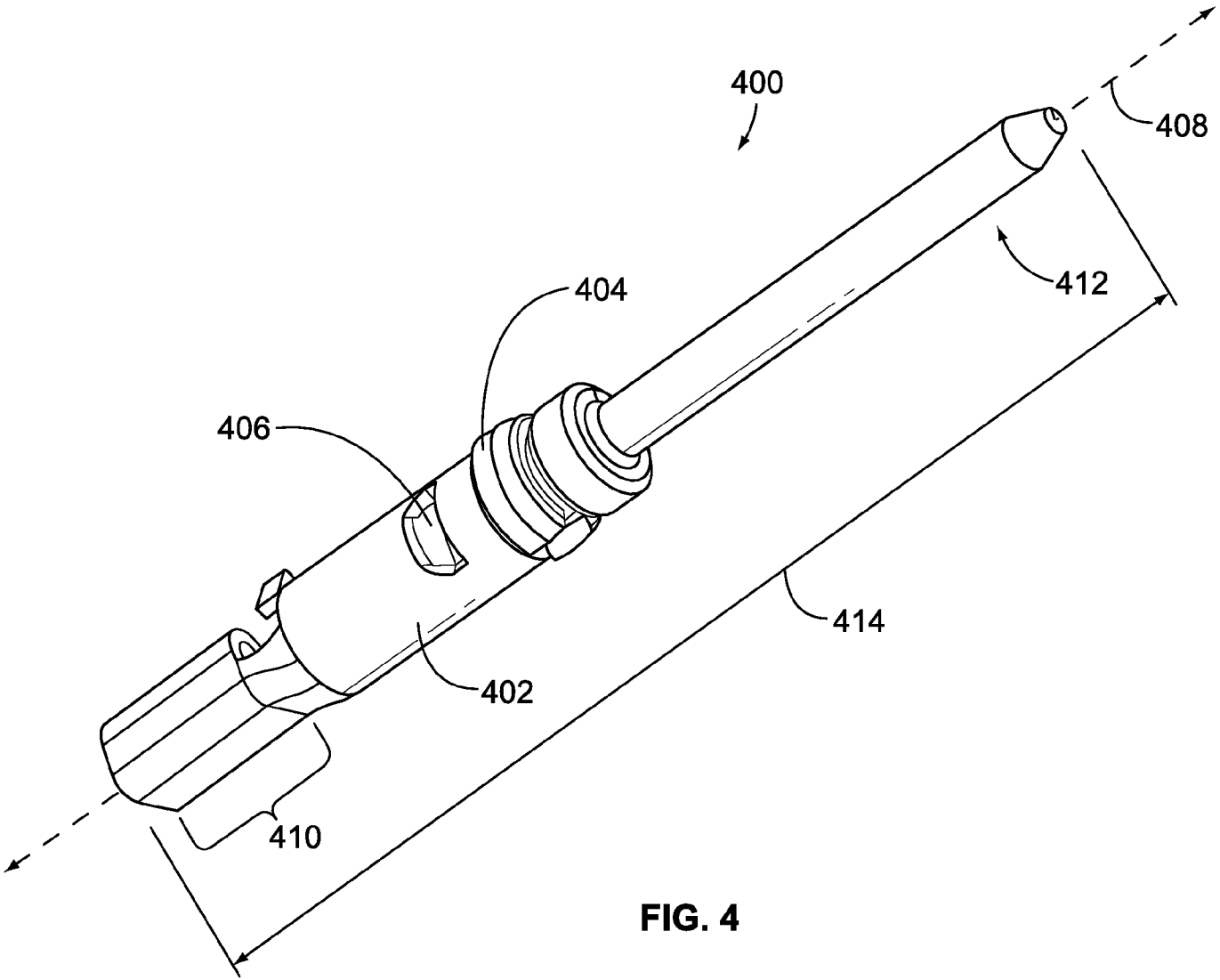
FIG. 4 is a perspective view of a contact according to an alternative embodiment.

FIG. 4 is a perspective view of a contact 400 according to an alternative embodiment. The contact 400 may be disposed in the contact housing 112 (shown in FIG. 1) in a manner similar to the contact 208 (shown in FIG. 2). The contact 400 includes a body 402 that includes, or is formed from, a conductive material. For example, the contact 400 may be stamped and formed from a sheet of conductive material. In another embodiment, the contact 400 may be screw machined from a block of conductive material. Alternatively, the contact 400 includes, or is formed from, a nonconductive material and at least a portion of the contact 400 is coated with a conductive material.

In the illustrated embodiment, the contact 400 includes a body 402 with a contact mating end 412 extending from one end of the body 402 and a crimp portion 410 extending from an opposing end of the body 402. The contact mating end 412 and the crimp portion 410 may be similar to the contact mating end 308 (shown in FIG. 3) and the crimp portion 306 (shown in FIG. 3). In one embodiment, the contact 400 is a relatively small contact. For example, the contact 400 may have an overall length 414 along a longitudinal axis 408 of the contact 400 of 0.750 inches or less.

The contact 400 includes a retention element 404 that engages the ledge 228 (shown in FIG. 2) of the contact housing 112 (shown in FIG. 1) to retain the contact 400 in the contact housing 112. The retention element 404 may include an annular ring. The retention element 404 is separately formed from the contact 400 in one embodiment. The retention element 404 may include, or be formed from, a nonconductive material. For example, the retention element 404 may be formed from a plastic material. The retention element 404 is radially biased inward as the contact 400 is loaded into the housing chamber 222 (shown in FIG. 2). The retention element 238 returns to an unbiased position once the contact 400 is loaded sufficiently far into the housing chamber 222 such that the retention element 404 is no longer biased inward. In the unbiased position, the retention element 404 may engage the ledge 228 to prevent the contact 400 from being removed from the housing chamber 222 in a direction toward the housing back end 214 (shown in FIG. 2). Alternatively, the retention element 404 may engage the ledge 226 (shown in FIG. 2) or another component of the contact housing 112 to prevent removal of the contact 400 from the contact housing 112. In another embodiment, the retention element 404 includes a component other than the annular ring described above.

In the illustrated embodiment, the body 402 includes an adhesive dam 406 that impedes or prevents egress of the adhesive from the interior chamber 204 (shown in FIG. 2) past the contact 400 in a direction toward the housing mating end 216 (shown in FIG. 2). For example, the adhesive dam 406 may prevent the adhesive from migrating through the body 402 past the adhesive dam 406. The adhesive dam 406 includes a portion of the body 402 that is bent inward towards the longitudinal axis 408. For example, the adhesive dam 406 may include a slug of the body 402 that is folded inward. In one embodiment, the adhesive dam 406 and body 402 are homogeneously formed with one another. For example, the adhesive dam 406 and the body 402 may be stamped and formed from the same sheet of conductive material. The adhesive dam 406 is included in the contact 208 (shown in FIG. 2) in one embodiment. Alternatively, the body 402 includes another component that impedes or prevents egress of the adhesive from the interior chamber 204 past the contact 400 in a direction toward the housing mating end 216. For example, the body 402 may include a plug (not shown) or other obstruction that prevents the egress of the adhesive past the contact 400.

One or more embodiments described herein provide connector assemblies formed of a plurality of discrete components that are bonded together with an adhesive. Forming discrete components and then bonding the components together may reduce the cost of manufacturing the connector assemblies as the various components can be manufactured in different locations where manufacturing costs may be reduced. The combined cost of manufacturing the several discrete components and bonding the components together may be less than the cost of manufacturing connector assemblies with overmolded contacts. The adhesive may secure the components together and seal the connector assembly to permit the use of the connector assembly in a variety of environments where the egress of moisture and other fluids into the connector assembly may otherwise be problematic. The contacts may be stamped and formed from a sheet of conductive material, which may further reduce the cost of manufacturing the connector assemblies. The use of an annular ring on the contacts in one or more embodiments may provide a reliable contact retention feature.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a boot body extending between a boot coupling end and a boot back end, the back end receiving a cable comprising a conductor, the boot body defining an internal chamber;

a contact housing extending between a housing mating end and a housing back end, the housing back end coupled to the boot coupling end such that the contact housing forwardly protrudes from the boot coupling end of the boot body, the housing mating end configured to mate with a mating connector to electrically connect the connector assembly and the mating connector; and a contact held in the contact housing and electrically connected to the conductor, wherein an adhesive is disposed in the internal chamber to secure the boot body and the contact housing together; wherein the contact comprises an adhesive dam configured to impede egress of the adhesive past the contact from the internal chamber toward the housing mating end.

2. The connector assembly of claim 1, wherein the boot body and the contact housing are discrete elements of the connector assembly.

3. The connector assembly of claim 1, wherein the adhesive seals the housing back end.

4. The connector assembly of claim 1, wherein the boot body comprises an adhesive port and an evacuation port, the adhesive placed into the internal chamber through the adhesive port and air in the internal chamber being evacuated from the internal chamber through the evacuation port as the adhesive is placed into the internal chamber.

5. The connector assembly of claim 1, wherein the adhesive dam comprises a portion of the contact that is bent inward.

6. The connector assembly of claim 1, wherein the contact housing includes an internal a retention ledge and the contact comprises a retention element that secures the contact in the contact housing by engaging the retention ledge.

7. The connector assembly of claim 6, wherein the retention element comprises an annular ring.

8. The connector assembly of claim 7, wherein the contact is loaded into the housing through the housing back end, the annular ring being radially compressed inward as the contact is loaded, the annular ring radially expanding once the annular ring is loaded into the housing past the retention ledge to engage the retention ledge.

9. A connector assembly comprising:

a boot body extending between a boot coupling end and a boot back end, the back end receiving a cable comprising a conductor;

a contact housing extending between a housing mating end and a housing back end, the housing back end coupled to the boot coupling end such that the contact housing protrudes from the boot coupling end of the boot body, the housing mating end configured to mate with a mating connector to electrically connect the connector assembly and the mating connector; and a contact held in the housing and electrically connected to the conductor, the contact stamped and formed from a sheet of conductive material, wherein the boot body and the contact housing are discrete elements secured together with an adhesive; wherein the contact comprises an adhesive dam configured to impede egress of the adhesive past the contact from the boot body toward the housing mating end.

10. The connector assembly of claim 9, wherein the boot body defines an internal chamber extending from the boot coupling end toward the boot back end, the adhesive disposed in the internal chamber to secure the boot body and the contact housing together.

11. The connector assembly of claim 9, wherein the boot body defines an internal chamber and comprises an adhesive port and an evacuation port, the adhesive loaded into the internal chamber through the adhesive port and air in the internal chamber being evacuated from the internal chamber through the evacuation port as the adhesive is loaded into the internal chamber.

12. The connector assembly of claim 9, wherein the adhesive dam comprises a portion of the contact that is bent inward.

13. The connector assembly of claim 9, wherein the contact housing comprises a retention ledge and the contact comprises a retention element that secures the contact in the contact housing by engaging the retention ledge.

14. The connector assembly of claim 13, wherein the retention element comprises an annular ring and the contact is loaded into the housing through the housing back end, the annular ring being radially compressed inward as the contact is loaded, the annular ring radially expanding once the annular ring is loaded into the housing past the retention ledge to engage the retention ledge.

15. A connector assembly comprising:

a boot body extending between a back end and a coupling end, the boot body comprising an interior chamber with an adhesive disposed therein;

a contact housing coupled to the boot body in a location proximate to the coupling end of the boot body;

a cable received in the back end of the boot body and extending through the interior chamber of the boot body, the cable comprising a conductor; and a contact electrically connected to the conductor in the cable, the contact held in the contact housing and configured to electrically connect with a mating contact in the mating connector to electronically connect the connector assembly and the mating connector, the contact comprising an adhesive dam that prevents passage of the adhesive past the adhesive dam, wherein the boot body and the contact housing is a discrete element, the boot body, contact housing and cable are secured with one another in the interior chamber by the adhesive.

16. The connector assembly of claim 15, wherein the adhesive seals the connector assembly in a location that is proximate to the coupling end of the boot body, the adhesive sealing the connector assembly to prevent ingress of moisture into the boot body from an interface between the boot body and the contact housing.

17. The connector assembly of claim 15, wherein the contact housing comprises a retention ledge and the contact comprises an annular ring, the annular ring securing the contact in the contact housing by engaging the retention ledge.

18. The connector assembly of claim 15, wherein the contact and the adhesive dam are stamped and formed from a common sheet of conductive material.

* * * * *